United States Patent [19]

Walz et al.

[11] 4,395,345

[45] Jul. 26, 1983

[54] FREE-FLOWING PHOSPHATE/SILICATE COGRANULATES CONTAINING HYDROPHOBING SUBSTANCE(S)

[75] Inventors: Kurt Walz, Glinde; Peter Dittmann, Oftersheim; Hartmut Höhne, Pfungstadt, all of Fed. Rep. of Germany

[73] Assignee: Lever Brothers Company, New York, N.Y.

[21] Appl. No.: 309,757

[22] Filed: Oct. 8, 1981 (Under 37 CFR 1.47)

[30] Foreign Application Priority Data

Oct. 10, 1980 [DE] Fed. Rep. of Germany ..... 3038413

[51] Int. Cl.[3] ..... C11D 3/04; C11D 3/08

[52] U.S. Cl. ..... 252/135; 252/140; 252/385

[58] Field of Search ..... 252/135, 140, 385, 174

[56] References Cited

U.S. PATENT DOCUMENTS

| | | | |
|---|---|---|---|
| 3,082,154 | 3/1963 | Allan | 252/385 |
| 3,932,316 | 1/1976 | Sagel et al. | 252/135 |
| 3,980,593 | 9/1976 | Knorre et al. | 252/385 |
| 4,196,095 | 4/1980 | Cala et al. | 252/385 |
| 4,265,779 | 5/1981 | Grandolfo et al. | 252/135 |

FOREIGN PATENT DOCUMENTS

| | | |
|---|---|---|
| 76 | 12/1978 | European Pat. Off. . |
| 1117087 | 12/1959 | Fed. Rep. of Germany . |

*Primary Examiner*—John E. Kittle
*Assistant Examiner*—Hoa Van Le
*Attorney, Agent, or Firm*—Milton L. Honig; James J. Farrell

[57] ABSTRACT

Cogranulates of alkalimetal tripolyphosphates and alkalimetal silicates are known as basic ingredients for machine dishwashing compositions. They can suffer from dispensability problems, and by inclusion in the cogranulates of a hydrophobing substance, such as calcium stearate, the dispensability can be improved.

4 Claims, No Drawings

FREE-FLOWING PHOSPHATE/SILICATE COGRANULATES CONTAINING HYDROPHOBING SUBSTANCE(S)

The present invention relates to free-flowing cogranulates of alkali metal tripolyphosphates and alkali metal silicates having an improved dispensability.

Free-flowing cogranulates of alkali metal tripolyphosphates and alkali metal silicates as basic ingredient for powdered detergent compositions, particularly machine dishwashing agents, are known from DE-PS No. 2,046,658. According to this patent specification these cogranulates are prepared by pelletising a mixture of powdered alkali metal tripolyphosphate and alkali metal silicate with water or an aqueous solution of the silicate and/or tripolyphosphate on a rotating pan, and subsequent drying.

Although the congranulates so obtained are generally good, free-flowing cogranulates, in particular their dispensability is often poor if not specific, critical conditions are fulfilled, such as a specific water content range.

The object of the invention, therefore, is to improve the dispensability of these known cogranulates, independently of their water content.

It has now been found that this object can be attained by incorporating into the cogranulates a hydrophobing substance.

By a hydrophobing substance is meant a substance which is water-insoluble or water-repellent.

By incorporating such a hydrophobing substance a premature moistening of the cogranulates, e.g. during the pre-rinsing stage in a dishwashing machine, with subseqent disintegration of the granules and formation of a barely soluble sludge is prevented to a maximum degree, thus essentially improving the dispensability of the cogranulates.

The present invention therefore relates to cogranulates of alkalimetal tripolyphosphates and alkalimetal silicates, if desired with incorporation of additional components, such as e.g. sodium carbonate or sodium sulphate, said cogranulates having an improved dispensability and being characterized in that they contain a hydrophobing substance.

It has appeared that particularly suitable hydrophobing substances are organic substances such as paraffins, silicones and insoluble fatty acid salts, for instance calcium stearate, as well as the zeolites (Na-Al-silicates). The hydrophobing substance should be selected and incorporated in such a way as to avoid adverse effects on physical properties of the products, resulting in e.g. clotting, discoloration or mechanical loss in the dishwashing machine. In general, the amount of hydrophobing substance ranges from 0.05 to 5.0 percent by weight, calculated on the cogranulate. Preferably it ranges from 0.1 to 1.0 percent by weight.

The incorporation of the hydrophobing substance in the cogranulates can take place before, during or after cogranulation, and it can be added to the cogranulates either in powder form or in the form of an aqueous solution or dispersion. Preferably however, the hydrophobing substance is added to the powdered mixture of the alkalimetal tripolyphosphate and alkalimetal silicate to be cogranulated, either in powder form or dissolved or dispersed in the granulation liquid. The latter method, however, if applied to barely soluble hydrophobing substances, can cause process-technical problems, if the hydrophobing substances are insufficiently dispersed.

The cogranulates are prepared in a manner known per se from a powdered mixture of alkalimetal tripolyphosphates and alkalimetal silicates, e.g. according to the process of DE-PS No. 2,046,658.

Instead of a rotating pan other granulation devices can be used, such as an Eirich pan type mixing device, a baffle type mixing device or a fluidised bed type mixer, or the like.

As alkalimetal tripolyphosphate in particular sodium tripolyphosphate can be used, and as alkalimetal silicate in particular the silicates with an $SiO_2/Na_2O$ weight ratio of 2.6 and lower, such as e.g. sodium metasilicate. In general, the cogranulates contain from 5.0 to 60.0 percent by weight of the alkalimetal tripolyphosphate, preferably from 20 to 45 percent by weight, and from 95 to 40 percent by weight of the alkalimetal silicate, preferably from 80 to 55 percent by weight.

The invention will be illustrated by the following Examples.

EXAMPLE 1

Cogranulates from 40% of sodium tripolyphosphate and 60% of sodium metasilicate were prepared as follows:

Powdered sodium tripolyphosphate and sodium metasilicate in a ratio of 40:60 were fed to a granulating pan via two pairs of dosing belt scales and a mixing screw and granulated in said pan by means of spraying water. The wet granulate was continuously conveyed from the pan overflow to a fluidised bed and dried in said bed by means of hot air to a residual water content of 7.7–13 percent, dependent on the specific test variant applied.

Subsequent sieving of fine and coarse particles resulted in obtaining a cogranulate having the structure required for further processing.

In a further step, calcium stearate or zeolite was mixed into these granulates (Test Series I).

In Test Series II, again calcium stearate was added to the cogranulates, after the latter had been highly dried, whereas in Test Series III the calcium stearate or the zeolite was added to the powdered sodium tripolyphosphate/sodium metasilicate as a solid before the cogranulation and the cogranulates were, if necessary, post-dried. All these cogranulates were subjected to dispensability tests in the following way:

The tests were carried out in a standard dishwashing machine (Miele G type), charged with 12 standard dishwashing sets, while using water of 23° dH (softening in the ion exchanger of the dishwashing machine).

The dry dosing chamber was filled with 45 g of test product and a universal cleaning programme was set. After 7 minutes and 40 seconds the cleaning cycle was interrupted, any residues were removed from the dosing chamber and dried in a crystallising (Petri) dish for 2 hours at 150° C.

The residue was then calculated as a percentage of the initial amount of product filled into the dosing chamber (45 g).

Of all the cogranulates without hydrophobing substance the water content was determined.

The following results were obtained:

| Cogranulate | % $H_2O$ (loss on heating) | Test Series I Dispensability (% R)* untreated cogranulate | after admixing 1% Ca—stearate | after admixing 1% zeolite |
|---|---|---|---|---|
| A | abt. 10 | 23 | 0/0/0** | 0/0/2 |
| B | 7.7 | 72 | 0/0/0 | 4 |

*% R = wt % of residue in the dosing chamber
**values of the test in triplicate

| Cogranulate | Test Series II % $H_2O$ (500° C.) untreated sample | after drying (30'/180° C.) | Dispensability (% R) untreated sample | after drying (30'/180° C.) | drying and mixing with 1% Ca—stearate |
|---|---|---|---|---|---|
| C | 12.9 | 3.7 | 0/26/0 | 62/45/+ | 0/0/0/0/0 |
| D | 13.0 | 4.2 | 0/0/1 | 53/53/57 | 0/0/0 |

+dosing chamber clogged owing to extremely big residue
% of residue could not be determined.

| | Test Series III non-post-dried Cogranulate % $H_2O$ (500° C.) | % R | post-dried (1 h/130–140° C.) cogranulate % $H_2O$ (500° C.) | % R |
|---|---|---|---|---|
| Cogranulate with 1% Ca—stearate | | | | |
| E | 10.6 | 0/0 | 4.3 | 0/0/0 |
| F | 10.5 | 0/0 | 4.2 | 0/0/0 |
| G | 9.0 | 0/0 | 3.3 | 0/0/0 |
| Cogranulate with 1% Zeolite | | | | |
| H | 10.8 | 0/0 | 5.1 | 0/0/ |
| J | 10.5 | 0/0 | 4.7 | 0/0/ |
| K | 11.2 | 0/0 | 5.5 | 0/0/ |

EXAMPLE II

Cogranulates from 40% sodium tripolyphosphate, 5% sodium carbonate and 55% sodium metasilicate were prepared as follows:

In Test Series I, powdered sodium tripolyphosphate, sodium carbonate and sodium silicate in a ratio of 40:5:55 were fed to a granulating pan via dosing belt scales and a mixing screw, and granulated in said pan by means of spraying water thereon. The wet granulate was continuously conveyed from the pan overflow into a fluidised bed, where it was dried by means of hot air to a residual water content of about 9–11%, dependent on the specific test variant applied.

Subsequent sieving of fine and coarse particles resulted in obtaining a cogranulate having a suitable structure for further processing.

In Test Series II an aqueous solution of 5% sodium tripolyphosphate and 5% calcium stearate was sprayed as a granulation liquid. The use of sodium tripolyphosphate in the granulation liquid is required in order to disperse the hydrophobic calcium stearate homogeneously.

After drying of the wet cogranulate the calcium stearate content in the final granulate amounted to about 1%.

The cogranulates from both test series were subjected to dispensability tests according to the same method as described in Example 1.

The following results were obtained;

| Cogranulate | Test Series I % $H_2O$ (loss on heating) 500° C. | Dispensability (% R)* |
|---|---|---|
| A | abt. 11% | 20/15/25** |
| B | abt. 9% | 50/45/55** |

*% R = wt % residue in dosing chamber
**test in triplicate with the same test product.

| Cogranulate with 1% Ca—stearate (from granulation liquid | Test Series II Untreated, non-post-dried cogranulate % $H_2O$ (500° C.) | % R | Post-dried cogranulate (1 h/130–140° C.) % $H_2O$ (500° C.) | % R |
|---|---|---|---|---|
| C | 10.4 | 0/0/0 | 4.5 | 0/0/0 |
| D | 9.2 | 0/0/0 | 3.5 | 0/0/0 |

We claim:

1. Cogranulates of alkalimetal tripolyphosphates and alkalimetal silicates with improved dispensability, said cogranulates comprising from 5 to 60 percent by weight of the alkalimetal tripolyphosphates, from 95 to 40 percent by weight of the alkalimetal silicates, and from 0.05 to 5 percent by weight of a hydrophobing substance, selected from the group consisting of paraffins, silicones, insoluble fatty acid salts and zeolites.

2. Cogranulates according to claim 1, comprising from 20 to 45 percent by weight of the alkalimetal tripolyphosphates, from 80 to 55 percent by weight of the alkalimetal silicates and from 0.1 to 1.0 percent by weight of the hydrophobing substance.

3. Cogranulates according to claim 1, in which the hydrophobing substance is calcium stearate.

4. Cogranulates according to claim 1, in which the hydrophobing substance is a zeolite.

* * * * *